United States Patent [19]

Miyata

[11] 4,181,055

[45] Jan. 1, 1980

[54] APPARATUS FOR AUTOMATICALLY CUTTING SHEET MATERIAL

[75] Inventor: Sinji Miyata, Higashiura, Japan

[73] Assignee: Hashimoto Denki Co., Ltd., Aichi, Japan

[21] Appl. No.: 937,459

[22] Filed: Aug. 28, 1978

[30] Foreign Application Priority Data

Feb. 14, 1978 [JP] Japan ..... 53/16279

[51] Int. Cl.[2] ..... B27L 5/08

[52] U.S. Cl. ..... 83/350; 83/356.2; 83/371; 83/213

[58] Field of Search ..... 83/371, 369, 255, 213, 83/208, 356.2, 356.3, 357, 350, 351

[56] References Cited

U.S. PATENT DOCUMENTS

| | | | |
|---|---|---|---|
| 2,711,792 | 6/1955 | McFall | 83/356.2 |
| 3,477,327 | 11/1969 | Aizawa | 83/371 |
| 3,760,667 | 9/1973 | Maxey et al. | 83/371 X |
| 4,033,212 | 7/1977 | Hasegawa | 83/371 X |
| 4,041,820 | 8/1977 | McGee | 83/356.2 |

*Primary Examiner*—Donald R. Schran

*Attorney, Agent, or Firm*—Wenderoth, Link & Ponack

[57] ABSTRACT

Two fixed blades are provided at substantially right angle with each other with a juncture line thereof being in the transverse direction and opposite to the terminal end of a feeding conveyor passage of a sheet material to be cut. Two movable cutter blades are also provided at substantially right angle with each other opposite to the fixed blades in such a manner that one cutter blade coacts with one fixed blade and the other cutter blade coacts with the other fixed blade to cut the sheet material at substantially right angle with respect to the plane of the sheet material. The two movable cutter blades are made to alternately advance and retreat at a predetermined timing.

10 Claims, 6 Drawing Figures

APPARATUS FOR AUTOMATICALLY CUTTING SHEET MATERIAL

BACKGROUND OF THE INVENTION

This invention relates to an apparatus for automatically cutting sheet material and, more particularly, to an apparatus suited for automatically cutting out irregular-shaped front and rear edges of wood plates such as veneers on a conveyor and then transporting the wood plates to another discharge conveyor for subsequent processing.

An apparatus of the kind has been provided as shown in a Japanese patent application laid open under No. 47-40392. In this known apparatus, upper and lower cutting knives are integrally provided on a holder and arranged to move substantially in a vertical direction relative to a wood plate which is advanced substantially in a horizontal direction. Accordingly, when a cutting operation is to be carried out, the advancement of the wood plate has to be stopped temporally. Thus, this known apparatus could not continuously convey the wood plates to be cut and, therefore, could not be used conveniently in connection with a veneer lathe which continuously and tangentially cut off a log into thin wood plates at a high speed.

As an apparatus which can continuously cut out the irregular-shaped front and rear edges of the wood plates without stopping the advancement thereof, there is provided a known apparatus as shown in Japanese patent publication No. 52-44072. In this known apparatus, a cutting blade is supported substantially in the horizontal direction and arranged to swing with a radius of curvature about a pivot shaft supporting the cutting blade. Accordingly, the cutting of the wood plate, which is advanced in the horizontal direction, cannot be effected vertically but is inclined with a small angle relative to the vertical line. Such inclined cutting operation of the blade often causes rip in the wood plate. In addition, since each wood plate has inclined front and rear cut end surfaces after cutting out the irregular edges, the adjoining wood plates could not be joined laterally with each other in the subsequent process for forming a long continuous final wood plate. Thus, these front and rear inclined ends of each wood plate had to be cut vertically before laterally joining in the subsequent process.

BRIEF SUMMARY OF THE INVENTION

Accordingly, an object of the present invention is to provide an apparatus which can automatically cut out an unusable part of a sheet material without stopping the advancement thereof.

Another object of the present invention is to provide an apparatus for automatically cutting out irregular-shaped front and rear edges of a wood plate without stopping the advancement thereof.

Another object of the present invention is to provide an apparatus which can cut out irregular-shaped front and rear edges of wood plates vertically relative to the horizontal plane of the wood plate.

Still another object of the present invention is to provide an apparatus wherein a wood plate, the front irregular edge of which has been cut out, is conveniently guided to a subsequent conveyor.

A further object of the present invention is to provide an apparatus wherein front and rear irregular edges cut out from a wood plate can be removed automatically from a transportation path of the wood plate.

Another object of the present invention is to provide an apparatus which can conveniently be combined with a high speed veneer lathe.

In an apparatus according to the present invention, two fixed blades are provided at substantially right angle with each other with a juncture line thereof being in the transverse direction and opposite to the terminal end of a feeding conveyor passage of a sheet material to be cut. Two movable cutter blades are also provided at substantially right angle with each other opposite to the fixed blades in such a manner that one cutter blade coacts with one fixed blade and the other cutter blade coacts with the other fixed blade to cut the sheet material at substantially right angle with respect to the plane of the sheet material. Means is provided to alternately advance and retreat the two movable cutter blades at a predetermined timing to cut the sheet material.

Preferably, this apparatus is applied to cut out irregular-shaped front and rear edges of a wood plate wherein one of the movable cutting blades serves to guide the front irregular edge of the wood plate to a place to be cut by the other movable cutting blade. This other movable cutting blade serves to guide the wood plate into a subsequent conveyor passage after cutting out the front irregular edge of the wood plate.

Other objects and features of the present invention will become apparent from the detailed description of a preferred embodiment of the present invention shown in the accompanying drawings, in which:

DETAILED DESCRIPTION OF THE INVENTION

Figure 1:
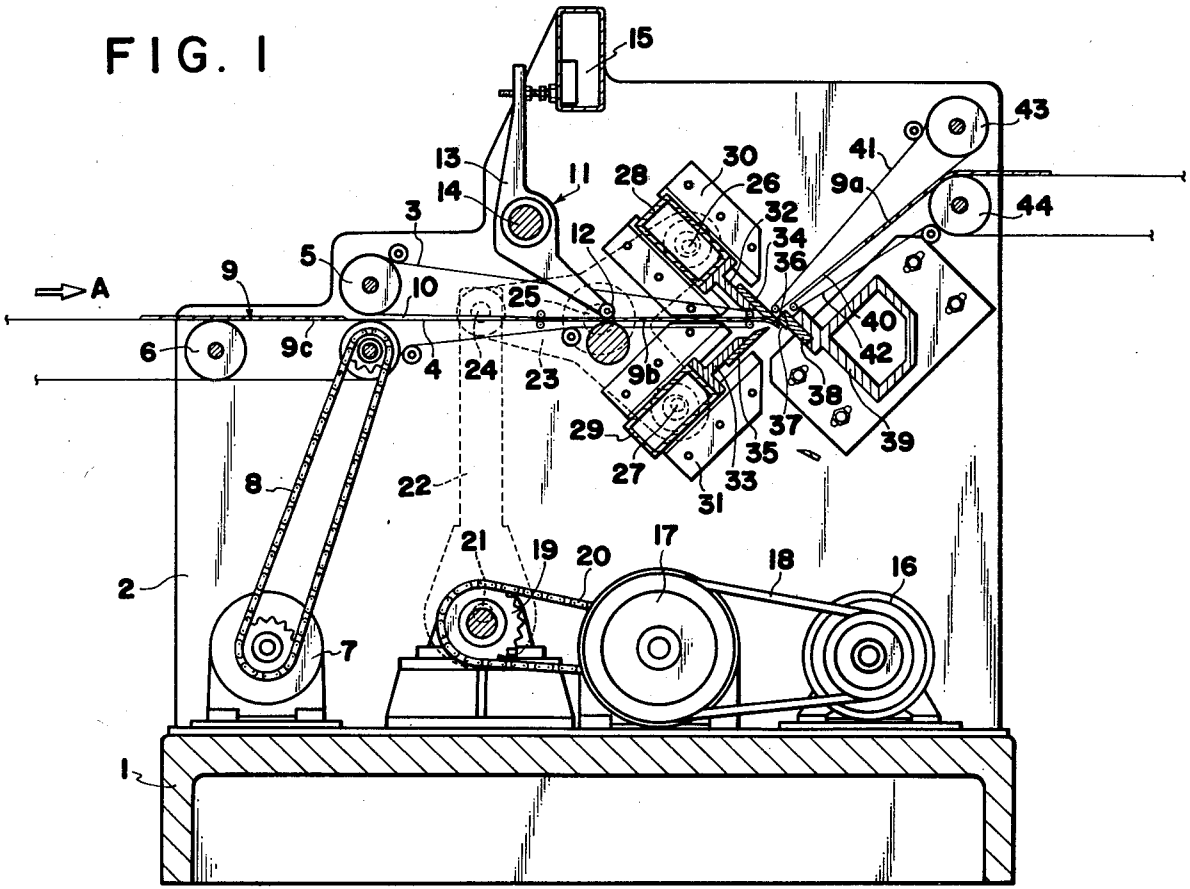
FIG. 1 is a partially sectioned side view showing main parts of an apparatus according to an embodiment of the present invention.
Figure 2:
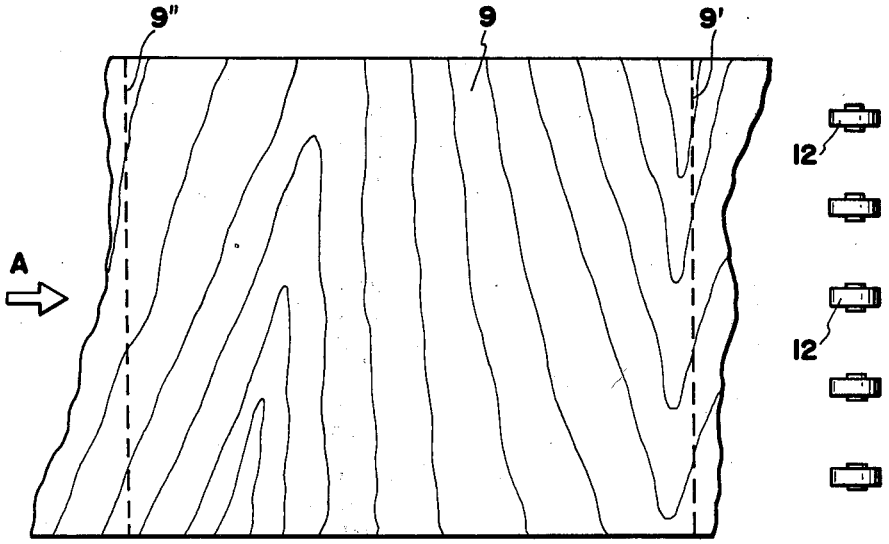
FIG. 2 is a plane view showing a wood plate having irregular-shaped front and rear edges to be cut out, and FIG. 3(*a*)–FIG. 3(*d*) are fragmentary sectional side views showing cutting operations in turn of movable cutting blades of the apparatus shown in FIG. 1.
Figure 3A:
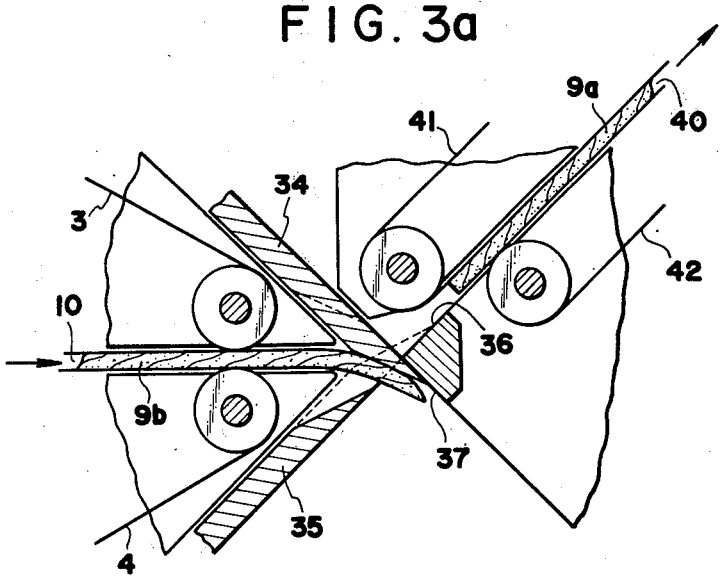
Figure 3B:
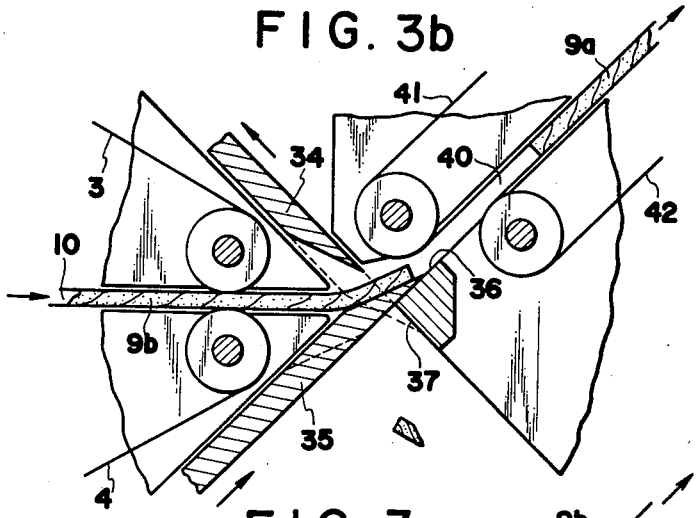
Figure 3C:
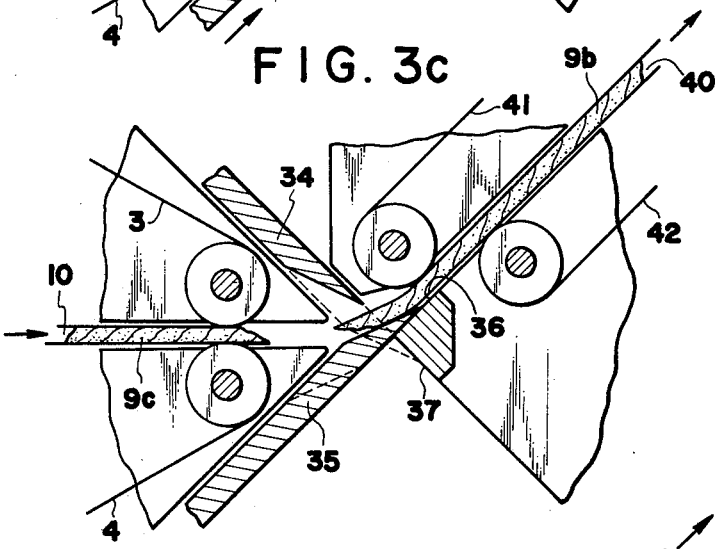
Figure 3D:
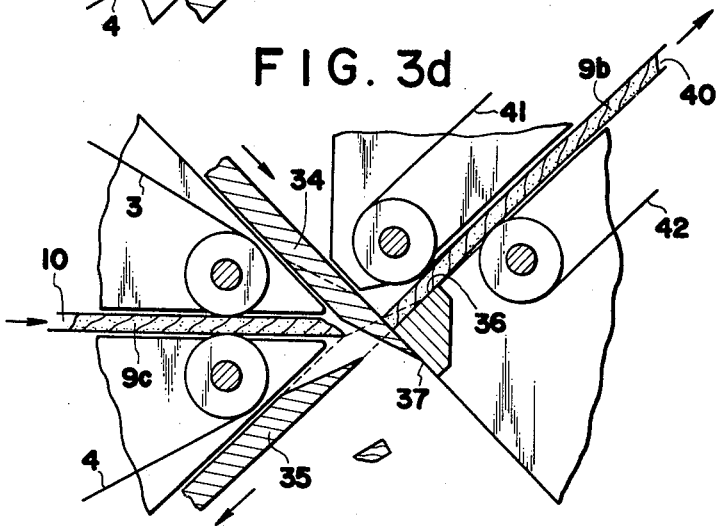

An apparatus of the present invention shown in FIG. 1 comprises a base frame 1 and a side frame 2 for supporting parts of the apparatus. A pair of upper and lower feeding conveyors 3 and 4 are supported on pulleys 5 and 6 mounted on the side frame 2, respectively. The lower feeding conveyor 4 is operatively connected with a motor 7 by an endless chain 8. Likewise, the upper feeding conveyor 3 is operatively connected with a motor 7 by another chain (not shown) in such a manner that the both feeding conveyors 3 and 4 are moved synchronously in the opposite directions to feed wood plates 9 on the lower feeding conveyor 4 in the direction shown by an arrow (A). The wood plate 9 on the feeding conveyor 4 is such one as veneer which has been cut off from a log into a thin flexible wood plate by a veneer lathe, so that the front and rear edges of the wood plate have irregular shapes as shown in FIG. 2. The conveyor passage 10 between the upper and lower conveyors 3 and 4 has a vertical space greater than the thickness of the wood plate at the feeding side. But the vertical space becomes gradually smaller toward the intermediate portion of the upper conveyor, from which the vertical space of the upper and lower conveyors becomes substantially equal to the thickness of the wood plate.

At the intermediate portion of the feeding conveyor passage, there is provided a device for detecting the irregular-shaped front and rear edges of the wood plate 9 to be cut out by a cutting device. The detecting device 11 in this embodiment comprises a series of detecting rollers 12 spaced from each other in the transverse direction of the conveyors 3 and 4 and each attached to the lower end of an arm 13 which is pivotable about a shaft 14. Connected to the upper end of each arm 13 is a limit switch in a switching box 15 which controls the cutting operation of the irregular edges of the wood plate. The detecting rollers 12 are arranged to be urged against the lower feeding conveyor 4 and to roll on the upper surface of the wood plate 9, so that when each detecting roller 12 rides on the irregular-shaped front edge of the wood plate by the advancement of the wood plate and also when the detecting roller gets down from the irregular-shaped rear edge of the wood plate by the further advancement of the wood plate on the lower conveyor 4, the arm 13 swings about the pivot thereof. By such pivoted swinging movements of the arms 13, an electrical circuit in the switching box 15 operatively connected to the upper ends of the arms through limit switches comes to operable conditions.

The electric circuit for effecting the cutting operation has contacts operated by limit switches connected to the upper ends of the pivotable arms 13 to the lower ends of which the detecting rotors are also connected. Each contact is associated with the limit switch to take an open state when the detecting roller is on the lower conveyor and a closed state when the rotary detector is on the wood plate 9. The electric circuit is formed such that a cutting signal for the front irregular edge of the wood plate is supplied when all of the detecting rollers ride on the wood plate from the lower conveyor to close all of the contacts in the electric circuit and that another cutting signal for the rear irregular edge of the wood plate is supplied when any one of the detecting rollers gets down on the lower conveyor from the wood plate. These cutting signals are transmitted to a cutting device with a predetermined time delay to actuate cutting blades. The electric circuit for effecting the cutting operation can be formed with reference to U.S. Pat. No. 3,477,327, so that the detailed description thereof is omitted herein.

The detectors for effecting the cutting operation may be any other type of detectors such as phote-electric responsive devices.

The cutting device of the present embodiment comprises an electric motor 16 mounted on a base frame 1. The motor 16 is operably connected with an electromagnetic clutch brake 17 on the base frame by a belt 18. The clutch brake 17 is in turn connected with a sprocket 19 also mounted on the base frame by a chain 20. The sprocket 19 has an eccentric crank shaft 21 on which a lower end portion of a vertical crank lever 22 is pivotably connected. The upper end portion of the vertical crank lever 22 is pivotably connected by a shaft 24 with an end of a lateral link 23 which is also pivotably supported on the side frame 2 by a shaft 25. The lateral link 23 is bifurcated toward the advancing direction of the wood plate 9, to the bifurcated end portions of which rotary eccentric shafts 26 and 27 are provided in circular bearings. Connected to the rotary eccentric shaft 26 and 27 are slidable blocks 28 and 29 which are arranged to be slidable along guide brackets 30 and 31, respectively, in the directions substantially at right angle relative to each other.

The slidable blocks 28 and 29 have connected thereto blade holders 32 and 33 to which upper and lower movable cutter blades 34 and 35 are firmly secured, respectively. These movable cutter blades are arranged to reciprocate in turn at prescribed time intervals.

The cutter blades 34 and 35 are arranged symmetrically relative to the conveyor passage 10 between the upper and lower conveyors 3 and 4 and to be extensible beyond the terminal end or exit of the conveyor passage 10. Each of the cutter blates 34 and 35 forms an angle of about 45 degrees relative to the extension line of the conveyor passage 10, so that both of the cutter blades 34 and 35 form a right angle therebetween. Provided opposite to the movable cutter blades 34 and 35 are upper and lower fixed blades 36 and 37, respectively, which are secured to a blade holder 28 which in turn is firmly attached to the side frame 2 by a bracket 39. The fixed blades 36 and 37 are also arranged at right angle with each other with a juncture line of the fixed blades facing the conveyor passage 10 and extending in the transverse direction of the conveyor passage 10. The upper fixed blade 36 coacts with the lower movable cutting blade 35 to cut out the irregular-shaped front edge of the wood plate 9, while the lower fixed blade 37 coacts with the upper movable cutting blade 34 to cut out the irregular-shaped rear edge of the wood plate. The internal place of the apparatus below the movable and fixed blades 34–37 is made free to allow the irregular edges cut out from the wood plate to drop down without being obstructed and to be taken out by a relevant means such as an additional conveyor.

Provided in line with the lower movable cutter blade 35 and the upper fixed blade 36 is a discharge conveyor passage 40 formed between a pair of upper and lower discharge conveyors 41 and 42. One end of the discharge conveyor passage 40 is closely adjacent to the upper fixed blade 36 to allow the wood plate advancing along the upper fixed blade 36 to enter into the passage 48. The discharge conveyors 41 and 42 are arranged to be operated at the same speed as the feeding conveyors 3 and 4 by another motor (not shown) which is operable connected to driving shafts on pulleys 43 and 44, respectively.

Referring now to an operation of the apparatus set forth above, wood pieces or wood plates 9 cut off by a veneer lathe and having irregular-shaped front and rear edges are successively placed on lower feeding conveyor 4 at intervals. By the movement of the lower conveyor 4 in the direction shown by arrow (A), the wood plates 9, which are flexible and often waved, are advanced in the conveyor passage 10 between the upper and lower feeding conveyors 3 and 4, where the wood plates are stretched into sheet form by the gradually reducing vertical space in the passage 10. During the advancement of the wood plate 9, the front irregular edge of the wood plate collides against the detecting rollers 12 and causes the arms 13 to partially swing about the shaft 14, whereby the detecting rollers 12 ride on the wood plate 9. Due to the swinging movement of each arm 13, the contact in the detecting electrical circuit associated with the limit switch on the arm is closed. When all of the detecting rollers 12—12 ride on the wood plate 9 to swing all of the arms 13—13, all contacts in the circuit are closed to actuate the circuit. Thus, the detecting circuit supplies an electrical signal to a cutting device with a predetermined time delay for cutting out the irregular front edge of the wood plate. By the further advancement of the wood plate 9, the detecting rollers 12 get down from the irregular-shaped rear edge of the wood plate. At the time when one of the detecting rollers gets down from the rear edge of the wood plate, due to the swinging movement of the arm 13 associated with the detecting roller, one of the contacts in the detecting circuit is open. The detecting circuit is so formed as to be activated again when one of the contacts is open from the closed states of all contacts. Therefore, an electrical signal is supplied to the cutting device with a predetermined time delay for cutting out the irregular rear edge of the wood plate. Chain 9' and 9'' in FIG. 2 shows front and rear cutting lines, respectively. Thus, the detecting device 11 allows to cut out the irregular front and rear edges with minimum length and to obtain a rectangular-shaped wood plate having maximum length.

The electrical cutting signal from the detecting device is transmitted to the electromagnetic clutch brake 17 in the cutting device with a predetermined time delay. When the signal is transmitted, the clutch brake 17 is released for a predetermined time interval during which the power of the motor 16 is transmitted to the crank shaft 21 of the sprocket 19 by way of the belt 18 and chain 20. By the rotation of the crank shaft 21, the crank lever 22 moves up or down. Therefore, the lateral link 23 pivoted to the upper end of the crank lever 22 swings about the shaft 25. When the lateral link 23 swings, for example, in the counterclockwise direction about the shaft 25 from the position shown in FIG. 1, the slidable block 28 for the movable upper cutting blade 34 retreats along the guide brackets 30 while the slidable block 29 for the movable lower cutting blade 35 advances along the guide brackets 31 to cut the wood plate 9 in cooperation with the upper fixed blade 36. Such retreating and advancing movements of the slidable blocks 28 and 29 are allowed due to the eccentric shafts 26 and 27 supported in circular bearings in the bifurcated end portions of the lateral link 23. Thus, when the electromagnetic clutch brake 17 is temporally released by the detecting signal, the crank lever 22 is moved up or down during which one of the movable cutter blades is retreated and simultaneously the other cutter blade is advanced to cut the wood plate.

The sequential cutting operations for the irregular-shaped front and rear edges of the wood plate shall be described with reference to FIG. 3(*a*)–FIG. 3(*d*). In FIG. 3(*a*), after cutting out the irregular-shaped rear edge of the preceding wood plate 9*a*, the movable cutting blades 34 and 35 keep the shown position for the succeeding wood plate 9*b*. That is, the movable upper cutter blade 34 extend beyond the terminal end or an exit of the first feeding conveyor passage 10 and contacts the lower fixed blade 37 to block an entrance of the second discharge conveyor passage 40, whereas the movable lower cutter blade 35 takes a retreated position below the level of the first conveyor passage 10. While the upper and lower movable cutter blades 34 and 35 are at these positions, the irregular-shaped front edge of the succeeding wood plate 9*b* carried by the conveyors 3 and 4 collides against a tapered end of the upper movable cutter blade 34 and is diverted downwardly along the lower end of the blade 34 since the wood plate 9*b* is thin and flexible.

At the time when the front cutting line 9' on the wood plate 9 becomes in line with the upper fixed blade 36, the upper movable cutter blade 34 is retreated automatically to open the entrance of the discharge conveyor passage 40 and simultaneously the lower movable cutter blade 35 is advanced automatically to cut out the front irregular-shaped edge of the wood plate 9 along the front cutting line 9' in cooperation with the upper fixed blade 36, as shown in FIG. 3(*b*). Such cutting operation along the predetermined cutting line can be effected accurately since the electrical cutting signal produced in the detecting device is transmitted to the cutting device so as to move the slidable block 35 at a certain time delay predetermined in view of the constant running speeds of the feed conveyors. When the irregular-shaped front edge of the wood plate 9 is cut out, it falls down into a free space below the lower cutter blades 35 and 37 and carried out of the apparatus by any relevant means such as an additional conveyor (not shown). After cutting out the front edge of the wood plate, the movable cutter blades 34 and 35 keep the same positions shown in FIG. 3(*b*) with the lower movable cutter blade 35 being in contact with the upper fixed blade, so that the lower movable cutter blade 35 functions as a guide for leading the wood plate 9 to the subsequent discharge conveyor passage 40 angularly inclined relative to the first conveyor passage 10. The wood plate 9 having entered into the discharge conveyor passage 40 is then carried along it by the action of the discharge conveyors 41 and 42 which run at the same speed as the feeding conveyors 3 and 4.

By the further advancement of the wood plate 9(*b*), the rear cutting line 9'' on the wood plate becomes to be in line with the lower fixed blade 37 as shown in FIG. 3(*c*). At this time, the movable lower cutting blade 35 is retreated and simultaneously the upper movable cutter blade 34 is advanced to cut out the irregular-shaped rear edge of the wood plate in cooperation with the lower fixed blade 37 as shown in FIG. 3(*d*). The irregular-shaped rear edge cut out from the wood plate falls down into the free space below the cutter blades and carried out of the apparatus as in the case of the front irregular edge.

The movable upper cutting blade 34 having cut out the irregular-shaped rear edge of the wood plate blocks the entrance of the discharge conveyor passage 40 and keeps the same position until the subsequent wood plate 9(*c*) is diverted downwardly along it to the extent that the front cutting line on the plate 9(*c*) is in line with the upper fixed blade 36.

Thereafter, the above cycle described in connection with FIG. 3(*a*) to FIG. 3(*d*) is repeated automatically in turn.

The wood plate having been cut into a rectangular shape without irregular front and rear edges is carriet to the next processing apparatus by the discharge conveyors 41 and 42.

As it could be understood from the disclosure set forth above, the combination of the movable cutting blades and fixed blades of the present apparatus makes it possible to cut out the irregular-shaped front and rear edges of the wood plate without stopping the movement of the wood plate. The irregular-shaped front and read edges of the wood plate are automatically separated and only the rectangular-shaped wood plate without the irregular edges is carried continuously to the subsequent processing step or apparatus. The cut faces at the front and rear ends of the rectangular-shaped wood plate become vertical and at right angle relative to the plane of the wood plate. The upper cutting blade also functions to guide the front edge of the wood plate to a cutting position, whereas the lower cutting blade functions to lead the wood plate, which has been cut into a rectangular shape, to the subsequent discharge conveyor passage.

The above advantage of the present apparatus that can effect the cutting operation without stopping the advancement of the wood plate makes it possible to directly connect the present apparatus with a known veneer lathe operable at a high speed. But, the present apparatus can be applied satisfactorily to a conventional system which intermittently stops the movement of the feeding conveyors on which the sheet plates to be cut are placed.

Although the present invention has been described with reference to a preferred embodiment thereof, many modifications and alterations may be made within the spirit of the present invention. For example, the present apparatus can be applied to cut other sheet materials such as metal sheet or plastic sheet. Further, the present apparatus can be applied to cut out a portion of the sheet material where an undesirable irregular-shaped hole or opening is preformed therein. In this case, the one movable cutter blade, described in the preferred embodiment as one for cutting out the irregular-shaped rear edge of the wood plate, is operated first to cut the sheet material adjacent to the front part of the irregular-shaped hole and then the other movable cutter blade is operated to cut the sheet material adjacent to the rear part of the irregular-shaped hole at a predetermined time delay.

What is claimed is:

1. An apparatus for automatically cutting a sheet material comprising a feed conveyor means on which the sheet material to be cut is placed, two fixed blades provided at substantially right angle with each other with a juncture line thereof being in the transverse direction and opposite to the terminal end of said feed conveyor means, two movable cutter blades also provided at substantially right angle with each other opposite to said fixed baldes in such a manner that one of said movable cutter blades coacts with one of said fixed blades and the other movable cutter blade coacts with the other fixed blade to cut said sheet material at substantially right angle with respect to the plane of said sheet material, and means for alternately advancing and retreating said two movable cutter blades at a predetermined timing.

2. An apparatus as claimed in claim 1, wherein said apparatus is adapted to cut out irregular-shaped front and rear edges of a wood plate and further comprises means for electrically detecting cut-out lines of said irregular-shaped front and rear edges of said wood plate, said detecting means producing electrical cutting signal by which said movable cutter blades are operated at a predetermined time delay.

3. An apparatus as claimed in claim 2, further comprising a discharge conveyor means angularly arranged relative to said feed conveyor means with the entrance of said discharge conveyor means being adjacent to the terminal end of said feed conveyor means, said movable cutter blades and fixed blades being provided between the terminal end of said feed conveyor means and the entrance of said discharge conveyor means, one of said movable cutter blade serving to guide the irregular-shaped front edge of said wood plate to a place to be cut by the other movable cutter blade, said other movable cutter blade serving to guide said wood plate to said discharge conveyor means after cutting out said irregular-shaped front edge.

4. An apparatus as claimed in claim 3, wherein said apparatus has a free space below said movable and fixed blades to allow the irregular-shaped front and rear edges cut out from said wood plate to be fallen down.

5. An apparatus as claimed in claim 3, wherein said movable cutter blades are arranged symmetrically relative to the plane of said feed conveyor means and to be extensible beyond the terminal end of said feed conveyor means.

6. An apparatus as claimed in claim 3, wherein said movable cutter blades are mounted to slidable blocks which are arranged at right angle with each other; said slidable blocks are connected to bifurcated end portions of a lateral link which is swingably pivoted to a frame; said lateral link is in turn pivoted to a vertical crank shaft; said vertical crank shaft is operably connected with a driving motor through an electromagnetic clutch brake; and said clutch brake is electrically connected with said detecting means.

7. An apparatus as claimed in claim 3, wherein said entrance of said discharge conveyor means is in line with one of said fixed blade.

8. An apparatus as claimed in claim 6, wherein each of said slidable block has a shaft eccentrically connected to a circular bearing in the bifurcated end portion of said lateral link.

9. An apparatus as claimed in claim 6, wherein said detecting means comprises a plurality of rollers each mounted to an end of a pivotable arm and arranged to run along the upper surface of said feed conveyor means on which said wood plate is placed, limit switches each associated with the other end of said pivotable arm, and an electric circuit having electrical contacts each closed or open when said limit switch is moved together with the pivoting movement of said arm, said electric circuit transmitting electrical signals to said electromagnetic clutch brake with a predetermined time delay when all of said lectrical contacts are closed and thereafter when any one of said contacts is open.

10. An apparatus as claimed in claim 7, wherein said feed conveyor means and said discharge conveyor means have the same running speed.

* * * * *